US007225571B2

(12) United States Patent
Rubalsky et al.

(10) Patent No.: US 7,225,571 B2
(45) Date of Patent: Jun. 5, 2007

(54) DEVICE FOR PRESENTING INFORMATION ABOUT PLANT MATERIALS

(75) Inventors: Sergey Dmitrievich Rubalsky, St. Petersburg (RU); Dmitry Vadimovich Aleshkin, St. Petersburg (RU)

(73) Assignee: Northern Dome LLC, Nashua, NH (US)

( * ) Notice: Subject to any disclaimer, the term of this patent is extended or adjusted under 35 U.S.C. 154(b) by 234 days.

(21) Appl. No.: 10/854,927

(22) Filed: May 27, 2004

(65) Prior Publication Data

US 2004/0238395 A1 Dec. 2, 2004

Related U.S. Application Data

(63) Continuation of application No. PCT/RU02/00253, filed on May 27, 2002.

(30) Foreign Application Priority Data

Nov. 30, 2001 (RU) ..... 2001133021

(51) Int. Cl.
*G09F 23/00* (2006.01)
*G09F 3/18* (2006.01)
*A01G 9/12* (2006.01)

(52) U.S. Cl. ..... 40/645; 40/661; 47/47; 206/471

(58) Field of Classification Search ..... 206/461–471, 206/423, 459, 232; 47/14, 65.7, 84, 44, 47; 40/645, 661
See application file for complete search history.

(56) References Cited

U.S. PATENT DOCUMENTS

| | | | | |
|---|---|---|---|---|
| 1,896,695 | A * | 2/1933 | Borovicka | 40/645 |
| 2,181,977 | A * | 12/1939 | Magovern | 40/645 |
| 2,461,054 | A * | 2/1949 | Miller | 40/645 |
| 2,850,160 | A * | 9/1958 | Siebel et al. | 206/464 |
| 2,975,889 | A * | 3/1961 | Brown | 206/470 |
| 3,122,441 | A * | 2/1964 | Smith | 206/471 |
| 4,000,580 | A * | 1/1977 | Biehl | 47/14 |
| 4,079,530 | A * | 3/1978 | Atherton et al. | 40/645 |
| 4,168,002 | A * | 9/1979 | Crosby | 206/459.5 |
| 4,534,125 | A * | 8/1985 | Buck | 40/645 |
| 4,731,028 | A | 3/1988 | Dickerson | |
| 4,946,034 | A * | 8/1990 | Matsubara | 206/471 |
| 6,253,478 | B1 * | 7/2001 | Kalavity | 40/645 |
| 6,327,804 | B1 * | 12/2001 | Shaw | 40/645 |

FOREIGN PATENT DOCUMENTS

| | | |
|---|---|---|
| DE | 3530640 | 3/1987 |
| FR | 2045562 | 3/1971 |
| GB | 2075465 | 11/1981 |
| GB | 2 321 445 | 7/1998 |
| RU | 2173291 | 9/2001 |

* cited by examiner

*Primary Examiner*—Bryon P. Gehman
(74) *Attorney, Agent, or Firm*—Houston Eliseeva LLP

(57) ABSTRACT

A data presentation device used in agriculture and advertising. The inventive data presentation device comprises a container provided with a pillar or post. The container is embodied in the form of a reusable blister package which comprises a base and a flanged cap.

11 Claims, 3 Drawing Sheets

DEVICE FOR PRESENTING INFORMATION ABOUT PLANT MATERIALS

FIELD OF THE INVENTION

This invention relates to an information presentation device and, more particularly but not exclusively, is concerned with an information presentation device for use in agriculture.

BACKGROUND OF THE INVENTION

A blister pack is universally known (RU 2173291 C2) A blister pack comprises a base and a cap provided with a flange. A stored article is placed under the cap, which cap is attached to the base by the flange. The cap is generally transparent. Thus a packed article is readily visible. Such blister packs can be used for storing seeds. However they cannot be used for presenting information about sown seeds.

A device for presenting information about sown plant seeds is shown in GB-A-2321445. This device comprises a cylindrical container on the top of a post which can be pushed into the ground. The container is provided with a dome which has a clamp for suspending a plaque. The plaque, secured in the clamp, is disposed within the container where it is not exposed to the environment. The container can be transparent or opaque. An opaque container is used to protect the information applied on the plaque from sun rays.

The structure of this device is difficult to fabricate, because it is difficult to adapt such a structure to streamlined manufacture. The device comprises three parts: a container provided with a post, a plug and a plaque. Consequently, such devices are relatively expensive. To use the device, an inscription must be made on the plaque. In the case of numerous plantings, such inscription becomes a labour-consuming operation. Further, inscriptions of this kind are abbreviated so that some information is lost.

The object of at least preferred embodiments of the invention is to provide a device for presenting information suitable to perform the following functions:

- to provide information about the sown plant seeds, or about chemicals (fertilizers, pest control agents) used to treat the soil or plants;
- to provide advertising information;
- to serve as a pack for plant seeds or chemicals.

SUMMARY OF THE INVENTION

According to the present invention there is provided an information presentation device which comprises:

(i) a plate which comprises a base which can serve as an information carrier and a post which is integral with said base, said base having an edge, and (ii) a cap which has a flange by which said cap can be removably mounted on the edge of said base, the arrangement being such that when said cap is mounted on said base a space between said cap and said base defines a container which overlies said base and can accommodate an information carrier.

Preferably said flange comprises a groove which, when said cap is mounted on said base, accommodates the edge of said base.

Advantageously said base is generally rectangular having two side edges, an end edge, and a portion which leads into said post.

Preferably said groove is adapted to receive at least part of the side edges and end edge of said base.

Advantageously said groove is adapted to receive the entire side edges and end edge of said base.

Preferably said portion which leads into said post comprises a neck which is narrower than the end edge of the base and flares outwardly towards the post.

Advantageously said groove is adapted to receive part of said neck.

Preferably said cap includes an opening through which, when said information presentation device is in use, any condensate which forms within said container can drain.

Advantageously said information presentation device includes advertising information on said base.

Preferably said information presentation device includes an information carrier in said container.

Advantageously said information carrier is a seed package.

Preferably said seed package contains seeds.

Advantageously said cap is transparent.

Preferably said post is pointed.

In preferred embodiments the post serves in use, to position the information presentation device on the ground. The information carrier can be an empty seed bag, a seed bottle, or a specially designed advertising information carrier.

For a better understanding of the present invention, and to show how the same may be carried into effect, reference will now be made by way of example, to the accompanying drawings, in which:—

Figure 1:
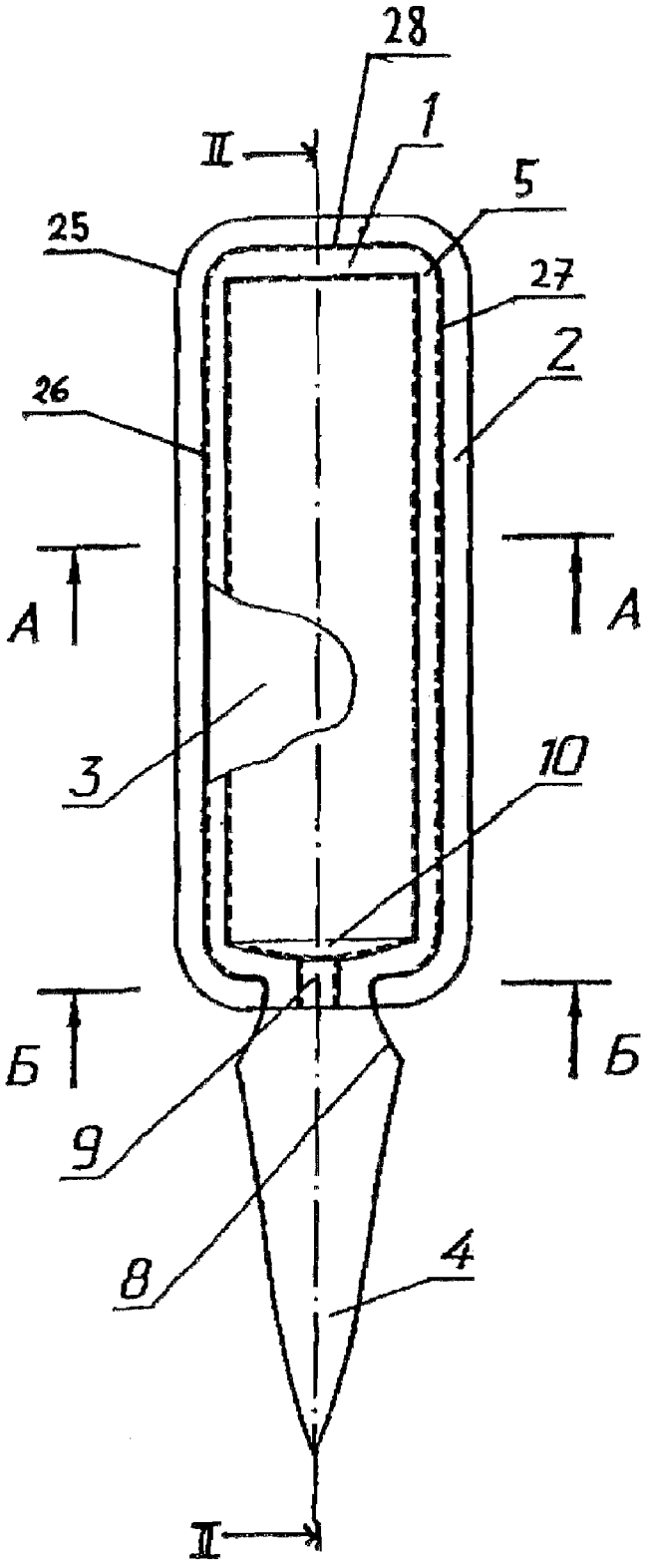
FIG. 1 is a front view of one embodiment of an information presentation device in accordance with the present invention.
Figure 2:
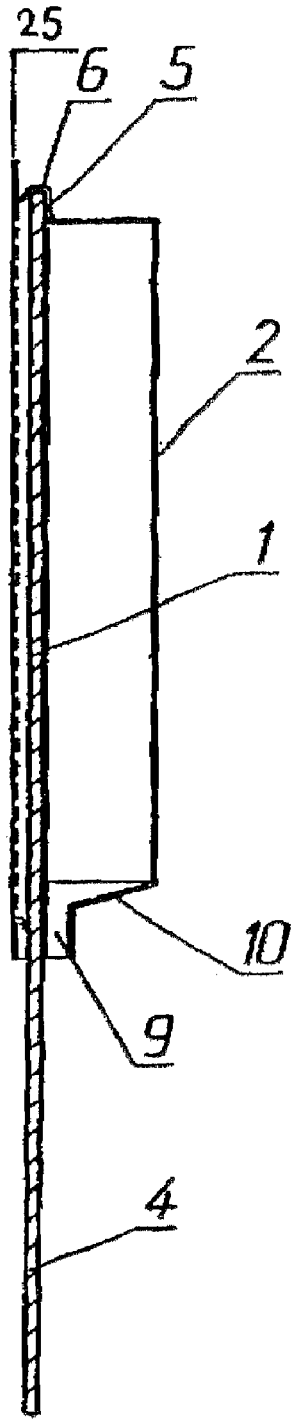
FIG. 2 is a section taken on line II-II of FIG. 1.
Figure 3:
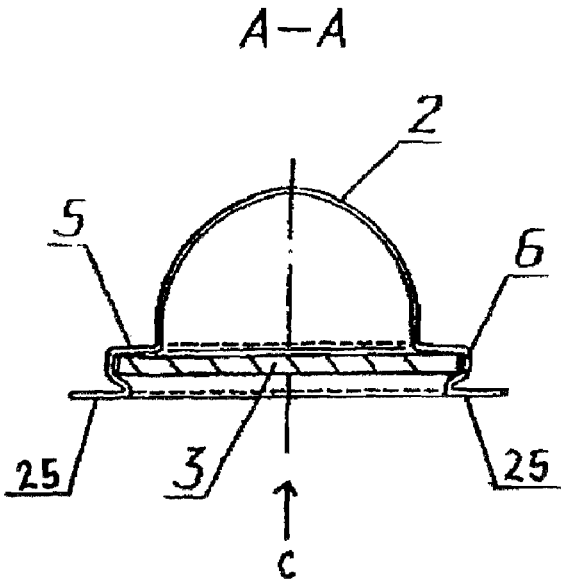
FIG. 3 is a section taken on line A-A of FIG. 1.
Figure 4:
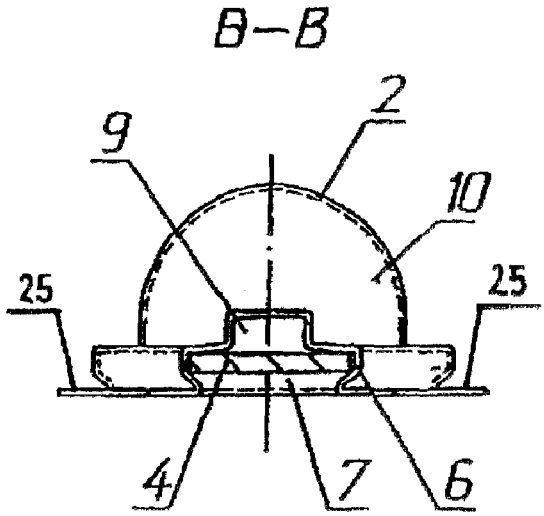
FIG. 4 is a section taken on line B-B of FIG. 1.
Figure 5:
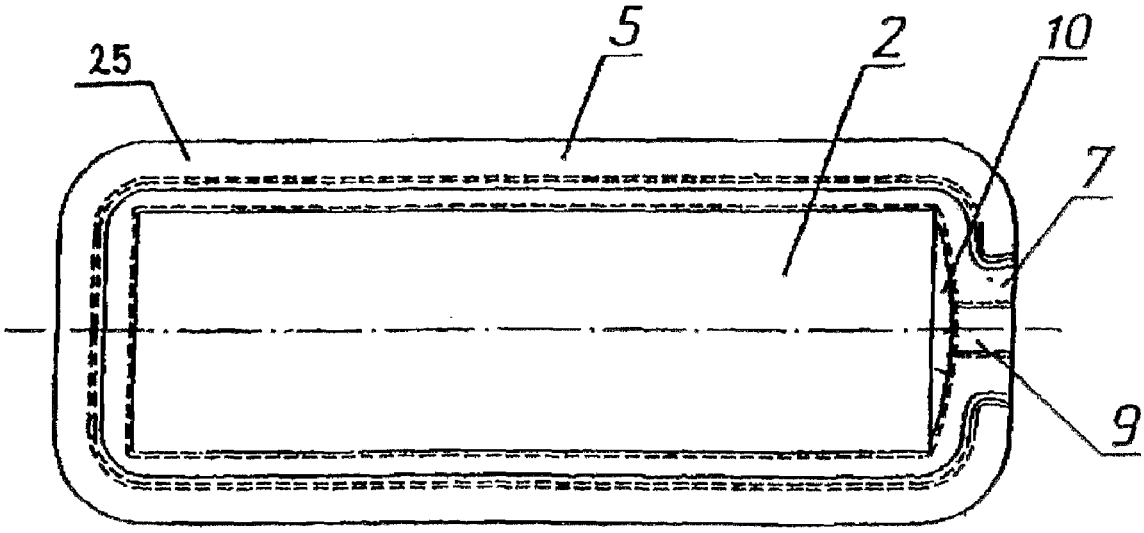
FIG. 5 is a front view of a cap which forms part of the information presentation device shown in FIG. 1.

Referring to FIGS. 1 to 5 of the drawings there is shown an information presentation device which comprises two parts: shaped plastic plate 1 (FIGS. 1 to 4) and transparent plastic cap 2. The information presentation device as assembled is illustrated in FIGS. 1 to 4. The transparent plastic cap 2 is separately illustrated in FIG. 5.

The shaped plastic plate 1 is a flat elongate member which comprises a base 3 and a post 4. The base 3 is generally rectangular and has two side edges 26, 27 and an end edge 28.

The transparent plastic cap 2 is provided with a flange 5 which defines a groove 6 (FIGS. 2, 3 and 4) which accommodates the edges of base 3. The flange 5 also includes an outwardly extending rim 25.

Flange 5 also defines a recess 7 (FIGS. 4 and 5) which accommodates a narrowed portion 8 (neck) of the base 3.

Recess 7 follows the shape of narrow end portion 8, so that the width of the recess 7 at the outer edge of the flange 5 is greater than that at the inner edge.

Recess 7 of flange 5 also defines a slot 9 (FIGS. 1, 2, 4 and 5) which communicates with the environment. Lower wall 10 of transparent plastic cap 2 is inclined, towards the slot 9.

The transparent plastic cap 2 and the base 3 are made of polyvinylchloride. The thickness of the transparent plastic cap 2 is 400 micron and the thickness of the shaped plastic plate 1 is 700 micron. Transparent plastic cap 2 and base 3 assembled together form the information presentation device.

Information is disposed on the flat surface of the shaped plastic plate 1 disposed inside or outside of the container which is defined between the base 3 and the transparent plastic cap 2.

To open the container, a user can grip post 4 with the fingers of one hand, and can grip the lower portion of the rim 25 of the flange 5 with the fingers of the other hand. As the hands are moved apart with a slight effort the transparent plastic cap 2 is detached from the base 3.

A user can put an empty bag of plant seeds which displays information about a plant into the transparent plastic cap 2, and can close the container by pressing the base 3 in the direction of the arrow 'C' (FIG. 3) into the shaped plastic plate 1 until the edges of the shaped plastic plate 1 engage in the groove 6. The user can then insert the post 4 into the ground on the sown site.

A characteristic sound (a click) is heard when transparent plastic cap 2 is attached to base 3, which attachment is also sensed tactually (with the user's fingers).

Any condensate formed inside the container flows, along inclined lower wall 10 and drains through slot 9.

The information presentation device reliably protects an information carrier against exposure to the environment. It is also an efficient advertisement carrier. While handling the device, a user can view an advertisement displayed on, either the front or the back of base 3, or on a seed pack disposed in the container.

Plastic cap 2 can be opaque. An opaque cap will better protect an information carrier against exposure to sun rays.

Post 4 can be implemented without narrow portion 8, or the narrow portion 8 can have another shape.

The groove 6 for retaining the transparent plastic cap 2 on base 3 does not have to extend along the entire circumference of the flange 5. A number of separate and distinct latches can be used to retain the transparent plastic cap 2 on base 3.

The information presentation device as shown in FIGS. 1 to 5 is the preferred embodiment.

Figure 6:
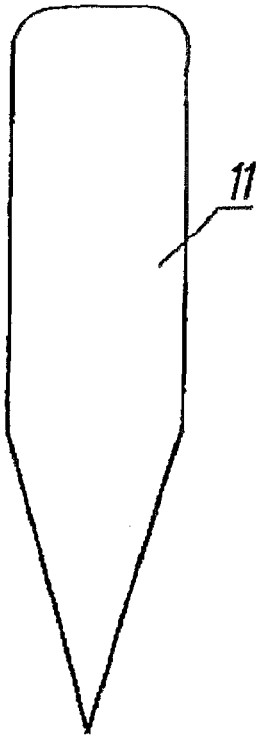
FIG. 6 is a front view of an alternative shaped plate which forms part of a second embodiment of an information presentation device in accordance with the present invention.
Figure 7:
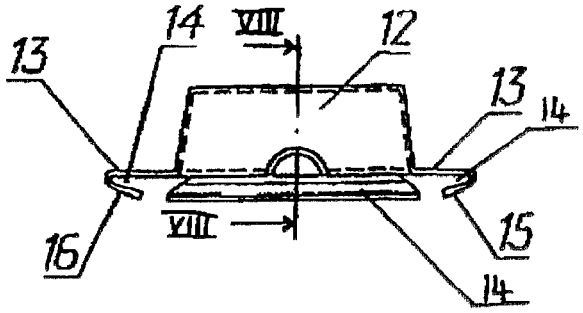
FIG. 7 is an underneath end view of a cap which can be used with the plate shown in FIG. 6.
Figure 8:
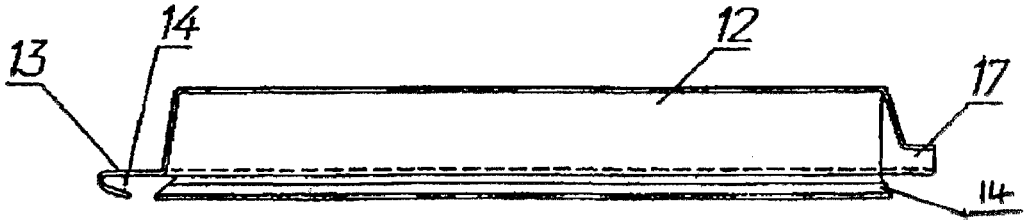
FIG. 8 is a section taken along line VIII-VIII of FIG. 7.
Figure 9:
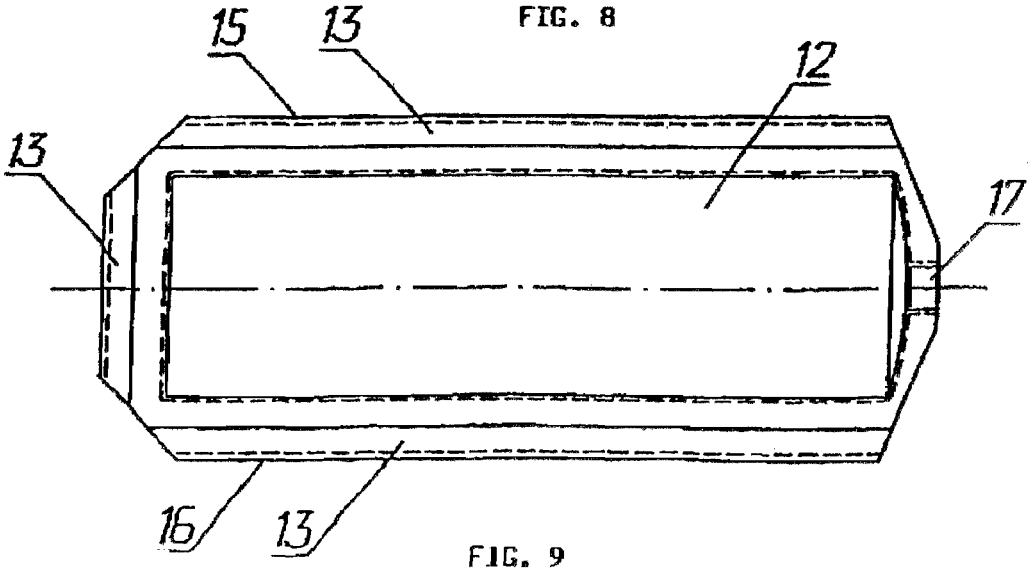
FIG. 9 is a front view of the cap shown in FIGS. 7 and 8.

FIGS. 6 to 9 of the drawings show an alternative information presentation device which comprises a shaped plastic plate 11 (FIG. 6) having a generally rectangular base and a transparent plastic cap 12, having a discontinuous flange 13 (FIGS. 6 to 9). Edges of flange 13 are bent and form grooves 14. The flange 13 extends only along the side portions and the top portion of the transparent plastic cap 12. The side portions of flange 13 constitute guides 15 and 16 for the base of the shaped plastic plate 11. Reference numeral 17 denotes an opening for the discharge of an) condensate. In this embodiment shaped plastic plate 11 is introduced into guides 15 and 16 through the lower portion of the transparent plastic cap 12.

What is claimed is:

1. An information presentation device comprising:

a plate comprising a base which can serve as an information carrier;

a post which is integral with the base with a portion of the base leading into the post, the base having edges; and a cap comprising a flange by which the cap can be removably mounted on the edges of the base, wherein the flange comprises a groove which, when the cap is mounted on the base, accommodates the edges of the base, the portion leading into the post comprises a neck which is narrower than the end edge of the base and flares outwardly toward the post and the groove is adapted to receive a portion of the neck, and wherein when the cap is mounted on the base a space between the cap and the base defines a container which overlies the base and can accommodate an additional information carrier.

2. The information presentation device of claim 1, wherein the cap further comprises an opening for draining any condensate that forms within the container when the container is in use.

3. The information presentation device of claim 2, further comprising advertising information disposed on the base.

4. The information presentation device of claim 2, wherein the base is rectangular with two side edges and an end edge, with a portion of the base leading into the post.

5. The information presentation device of claim 4, wherein the groove is shaped to receive at least part of the side edges and the end edge of the base.

6. The information presentation device of claim 5, wherein the groove is shaped to receive the entire side edges and the end edge of the base.

7. The information presentation device of claim 2, further comprising an additional information carrier in the container.

8. The information presentation device of claim 7, wherein the additional information carrier is a seed package.

9. The information presentation device of claim 1, wherein the cap is transparent.

10. The information presentation device of claim 1, wherein the cap further comprises an opening for draining any condensate that forms within the container when the container is in use.

11. The information presentation device of claim 1, wherein the base is rectangular with two side edges and an end edge, with a portion of the base leading into the post.

* * * * *